US010270186B2

(12) United States Patent
Teshima et al.

(10) Patent No.: US 10,270,186 B2
(45) Date of Patent: Apr. 23, 2019

(54) ANTENNA MODULE AND ELECTRONIC DEVICE

(71) Applicant: KABUSHIKI KAISHA TOSHIBA, Minato-ku, Tokyo (JP)

(72) Inventors: Masao Teshima, Tokyo (JP); Akihiro Tsujimura, Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 417 days.

(21) Appl. No.: 15/019,018

(22) Filed: Feb. 9, 2016

(65) Prior Publication Data

US 2017/0062953 A1 Mar. 2, 2017

Related U.S. Application Data

(60) Provisional application No. 62/212,140, filed on Aug. 31, 2015.

(51) Int. Cl.

| | |
|---|---|
| ***H01Q 21/28*** | (2006.01) |
| ***H01Q 1/24*** | (2006.01) |
| ***H01Q 3/24*** | (2006.01) |
| ***H01Q 9/42*** | (2006.01) |
| ***H01Q 21/06*** | (2006.01) |

(52) U.S. Cl.

CPC ..... *H01Q 21/28* (2013.01); *H01Q 1/243* (2013.01); *H01Q 3/24* (2013.01); *H01Q 9/42* (2013.01); *H01Q 21/065* (2013.01)

(58) Field of Classification Search

CPC ..... H01Q 3/24; H01Q 21/065; H01Q 21/28; H01Q 1/243

See application file for complete search history.

(56) References Cited

U.S. PATENT DOCUMENTS

| | | | | |
|---|---|---|---|---|
| 6,529,166 | B2 * | 3/2003 | Kanamaluru | H01Q 25/00 343/700 MS |
| 6,768,476 | B2 * | 7/2004 | Lilly | H01Q 1/243 343/700 MS |
| 6,795,020 | B2 * | 9/2004 | Sreenivas | H01Q 1/38 343/700 MS |
| 7,760,154 | B2 * | 7/2010 | Sekine | H01Q 1/38 343/795 |

(Continued)

FOREIGN PATENT DOCUMENTS

| | | |
|---|---|---|
| JP | 2005-322972 A | 11/2005 |
| JP | 2010-074344 A | 4/2010 |

(Continued)

*Primary Examiner* — Dameon E Levi

*Assistant Examiner* — Ab Salam Alkassim, Jr.

(74) *Attorney, Agent, or Firm* — Foley & Lardner LLP

(57) ABSTRACT

According to one embodiment, an antenna module includes a substrate, a first antenna, an array antenna, and a radio frequency (RF) module. The first antenna includes a first radiation element arranged on the substrate and a first ground plane arranged on the substrate. The array antenna includes a plurality of second radiation elements arranged on the substrate. The substrate includes a first surface and a second surface. The first ground plane is arranged on at least the first surface of the substrate. The plurality of second radiation elements are arranged on the second surface of the substrate and opposed to the first ground plane via the substrate.

10 Claims, 14 Drawing Sheets

(56) References Cited

U.S. PATENT DOCUMENTS 7,791,552 B1 * 9/2010 Romanofsky ..... H01Q 15/148 343/700 MS
8,902,117 B2 * 12/2014 Ohno ..... H01Q 19/30 343/795
9,502,778 B2 * 11/2016 Shinkai ..... H01Q 1/38
9,793,963 B2 * 10/2017 Grau Besoli ..... H04B 7/0617
2003/0122724 A1 * 7/2003 Shelley ..... H01Q 1/525 343/786
2004/0155820 A1 * 8/2004 Sreenivas ..... H01Q 1/38 343/700 MS
2008/0150825 A1 * 6/2008 Higaki ..... H01Q 1/243 343/820
2008/0258978 A1 * 10/2008 Stuart ..... H01Q 9/0407 343/700 MS
2009/0135078 A1 * 5/2009 Lindmark ..... H01Q 1/523 343/844
2009/0140929 A1 * 6/2009 Inoue ..... H01Q 1/243 343/700 MS
2009/0231225 A1 * 9/2009 Choudhury ..... H01Q 3/26 343/770
2011/0279338 A1 * 11/2011 Myszne ..... H01Q 1/243 343/725
2012/0026054 A1 * 2/2012 Liu ..... H01Q 21/065 343/824
2012/0098708 A1 * 4/2012 Takasu ..... H01Q 1/2266 343/702
2013/0027268 A1 * 1/2013 Ohno ..... H01Q 9/285 343/818
2013/0050016 A1 * 2/2013 Kim ..... H01L 23/5227 342/195
2013/0187830 A1 * 7/2013 Warnick ..... H01Q 5/35 343/893
2014/0097995 A1 * 4/2014 McKinzie, III ..... H01Q 9/0407 343/793
2014/0266902 A1 * 9/2014 Kamgaing ..... H01P 11/00 342/374
2014/0375502 A1 * 12/2014 Foo ..... H01Q 3/34 342/371
2015/0116169 A1 * 4/2015 Ying ..... H01Q 21/28 343/729
2015/0148098 A1 * 5/2015 Grau Besoli ..... H04B 7/0617 455/553.1
2015/0288053 A1 * 10/2015 Saxe ..... H01Q 1/243 343/702
2015/0349421 A1 * 12/2015 Sharawi ..... H01Q 3/40 342/373
2016/0011091 A1 * 1/2016 Huang ..... G01N 3/24 73/841
2016/0141740 A1 * 5/2016 Natsuhara ..... H01P 5/107 333/239
2016/0248169 A1 * 8/2016 Mohammadian .... H01Q 21/065
2016/0277555 A1 * 9/2016 Lee ..... H04M 1/236
2017/0012359 A1 * 1/2017 Jung ..... H01Q 3/30
2017/0040711 A1 * 2/2017 Rakib ..... H01Q 1/246
2017/0062937 A1 * 3/2017 Ganchrow ..... H01Q 9/0421
2017/0093049 A1 * 3/2017 Lahti ..... H01Q 9/30
2017/0141465 A1 * 5/2017 Sharawi ..... H01Q 1/48
2017/0222316 A1 * 8/2017 Mizunuma ..... H01Q 1/38
2017/0237154 A1 * 8/2017 Choudhury ..... H01Q 3/26 343/824

FOREIGN PATENT DOCUMENTS

JP 2012-090228 A 5/2012
JP 2014-179985 A 9/2014

* cited by examiner

ANTENNA MODULE AND ELECTRONIC DEVICE

CROSS-REFERENCE TO RELATED APPLICATIONS

This application claims the benefit of U.S. Provisional Application No. 62/212,140, filed Aug. 31, 2015, the entire contents of which are incorporated herein by reference.

FIELD

Embodiments described herein relate generally to technology for wireless communication using an antenna for a lower frequency band and an antenna for higher frequency bands.

BACKGROUND

Recently, a fifth-generation cellular system has been reviewed as a successor to the fourth-generation cellular systems such as Long Term Evolution (LTE).

The adoption of a new radio access technology (RAT) in addition to the existing LTE system has been reviewed in the fifth-generation cellular system. A frequency band higher than the frequency bands (cellular frequency bands) used in the LTE system will be used to implement high-speed wireless communication in the new radio access technology.

Antennas of two different types, i.e., an antenna for a lower frequency band (cellular frequency band) and an antenna for higher frequency bands are therefore required for a wireless device conforming to the fifth-generation cellular system. This matter may be a cause for increasing antenna implementation space which should be secured in the wireless device.

Thus, a new antenna structure which can suppress increase in antenna implementation space is required.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, an antenna module comprises a substrate, a first antenna, an array antenna, and a radio frequency (RF) module. The first antenna comprises a first radiation element arranged on the substrate and a first ground plane arranged on the substrate, and transmits and receives electromagnetic waves of a first frequency band. The array antenna comprises a plurality of second radiation elements arranged on the substrate, and transmits and receives electromagnetic waves of a second frequency band higher than the first electromagnetic wave. The radio frequency (RF) module is connected to the array antenna, and feeds radio frequency (RF) signals of the second frequency band to the array antenna. The substrate includes a first surface and a second surface. The first ground plane is arranged on at least the first surface of the substrate. The plurality of second radiation elements are arranged on the second surface of the substrate and opposed to the first ground plane via the substrate. The first ground plane and the plurality of second radiation elements function as a plurality of patch antennas.

Figure 1:
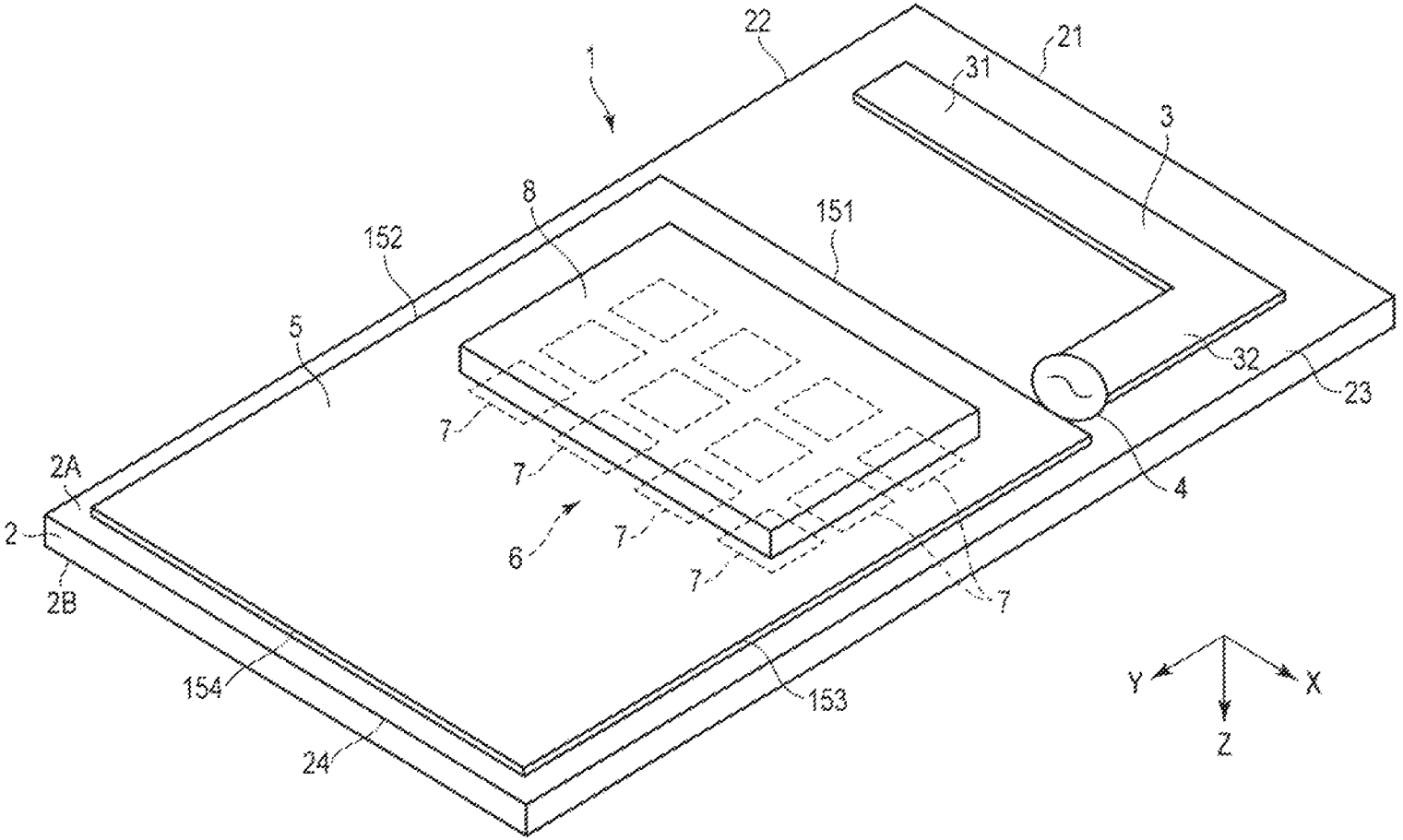
FIG. 1 is an exemplary perspective view showing an antenna module of one of embodiments seen from a surface side thereof.
Figure 2:
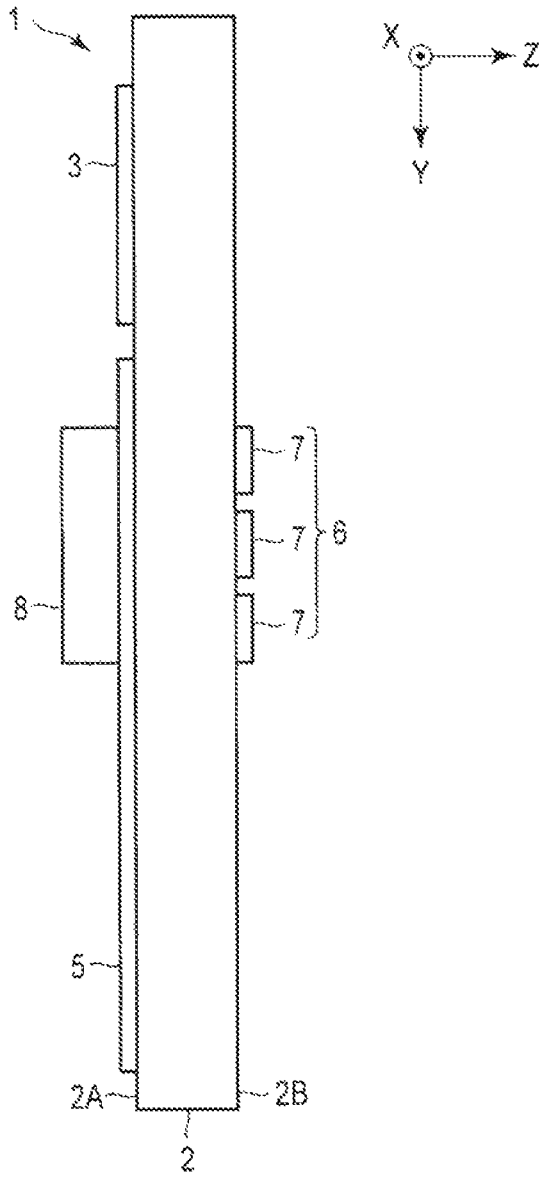
FIG. 2 is an exemplary side view showing the antenna module of the embodiment.
Figure 3:
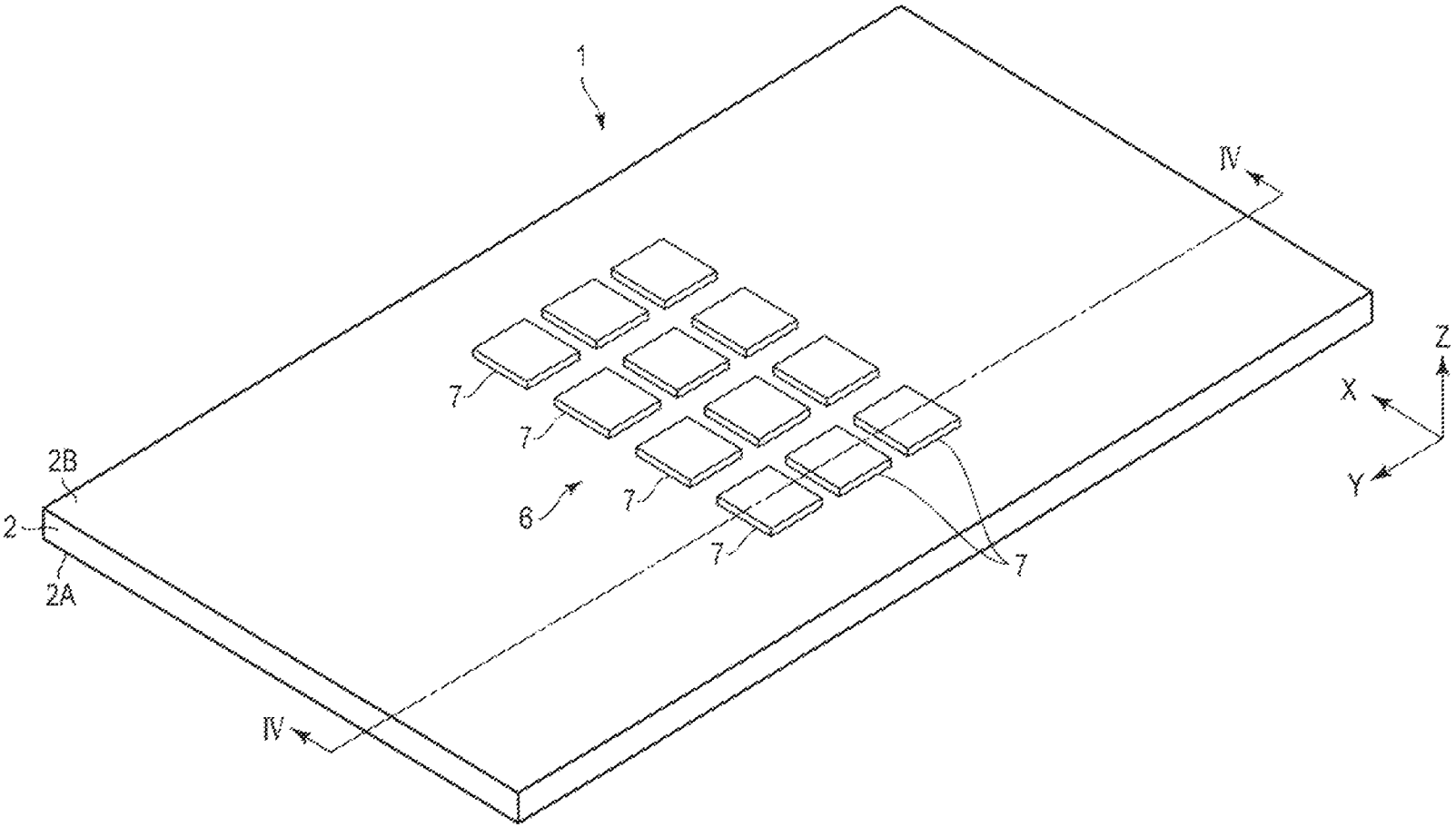
FIG. 3 is an exemplary perspective view showing the antenna module of the embodiment seen from a back surface side thereof.

First, a structure of an antenna module 1 of the embodiment will be explained with reference to FIG. 1, FIG. 2 and FIG. 3. FIG. 1 is a perspective view showing the antenna module 1 seen from a surface side thereof, FIG. 2 is a side view showing the antenna module 1, and FIG. 3 is a perspective view showing the antenna module 1 seen from a back surface side thereof.

The antenna module 1 may be installed in an electronic device (wireless device) configured to execute wireless communication with a cellular communication system such as a fifth-generation cellular system. The antenna module 1 is implemented as an integrated antenna module in which an antenna for a lower frequency band and an antenna for a higher frequency band are integrated on the same substrate.

Use of not only existing macro-cells, but also a plurality of small-cells additionally arranged in each of the macro-cells, in the cellular communication system such as a fifth-generation cellular system has been reviewed.

The antenna for a lower frequency band in the integrated antenna module 1 may be used for wireless communication with a macro-cell base station and the antenna for a higher frequency band in the integrated antenna module 1 may be used for wireless communication with a small-cell base station.

The lower frequency band may include a frequency band (cellular frequency band) used in an existing LTE system such as LTE or LTE-Advanced. In contrast, the higher frequency band may include a frequency band higher than the cellular frequency, for example, a millimeter-wave frequency band (for example, higher than or equal to 30 GHz).

The lower frequency band may be used for communication using control signals (control plane: C-Plane) of the cellular communication system and the higher frequency band may used for communication using data signals (user plane: U-Plane) of the cellular communication system.

The integrated antenna module 1 comprises a substrate (antenna substrate) 2. The antenna for a lower frequency band used for wireless connection with the LTE system (macro-cell) and the antenna for the higher frequency band used for wireless connection with the new RAT (small-cell) such as the millimeter-wave radio system, are mounted on the same substrate (antenna substrate) 2.

The substrate 2 is a dielectric substrate. The substrate 2 may be configured by, for example, a printed circuit board (PCB). The substrate 2 is in the form of a plate having two planar surfaces (a top surface and a back surface). The substrate 2 may be in the form of a rectangle having four edges 21, 22, 23 and 24.

The antenna for a lower frequency band functions as an LTE antenna configured to execute wireless communication with a macro-cell base station in a lower frequency band (cellular frequency band). The LTE antenna is configured to transmit and receive electromagnetic waves in the existing lower frequency band (cellular frequency band) used in the cellular communication system.

The LTE antenna may be a monopole type antenna such as an inverted-F antenna or an inverted-L antenna. The LTE antenna comprises an LTE antenna element 3 which is a line-shaped radiation element arranged on the substrate 2, and a ground plane 5 arranged on the substrate 2.

The LTE antenna element 3 and the ground plane 5 may be arranged on the same surface of the substrate 2 or arranged on two different surfaces (top surface 2A and back surface 2B) of the substrate 2, respectively.

In the antenna structure shown in FIG. 1 to FIG. 3, the LTE antenna element 3 and the ground plane 5 are arranged on the same surface of the substrate 2, for example, the top surface (first surface) 2A of the substrate 2.

The LTE antenna element 3 is formed of a conductor. The LTE antenna element 3 may be formed in a conductor pattern on the top surface (first surface) 2A of the substrate 2. The LTE antenna element 3 may comprise at least a conductor 31 and a conductor 32. The conductor 31 is in an elongated shape and is extended parallel to an extending direction (X-direction) of the upper edge 21 of the substrate 2. The conductor 32 is in an elongated shape and is extended in a perpendicular direction from an end portion of the conductor 31 to make connection between the end portion of the conductor 31 and a feed point 4.

The feed point 4 is arranged between the LTE antenna element 3 and the ground plane 5. The feed point 4 can be implemented by a coaxial connector connected to a coaxial cable. In this case, an inner conductor of the coaxial cable is electrically connected to the LTE antenna element 3 (i.e., the conductor 32 of the LTE antenna element 3) via the coaxial connector. In contrast, the outer conductor of the coaxial cable is electrically connected to the ground plane 5 via the coaxial connector.

The ground plane 5 may be formed in a conductor pattern on the top surface (first surface) 2A of the substrate 2. The ground plane 5 is a conductor having a planar surface. The ground plane 5 may be in the form of a rectangle having four edges 151, 152, 153 and 154. The edge 151 of the ground plane 5 is extended parallel to an extending direction (X direction) of the conductor 31 of the LTE antenna element 3, and is opposed to the conductor 31 of the LTE antenna element 3 with a gap therebetween.

The ground plane 5 plays a role of improving the radiation property of the LTE antenna element 3. The ground plane 5 has an area predetermined in accordance with the frequency band corresponding to the LTE antenna. Typically, the top surface (first surface) 2A of the substrate 2 includes a first region in which the LTE antenna element 3 is arranged and a second region in which the ground plane 5 is arranged, and the second region is set to be larger than the first region. The ground plane 5 may be large enough to cover a substantially entire surface of the second region.

As explained above, the LTE antenna is a monopole type antenna, and the current flows to not only the LTE antenna element 3, but also the ground plane 5. At the ground plane 5, a large amount of current flows along each edge (151, 152, 153 and 154) on the periphery of the ground plane 5.

The antenna for the higher frequency band is an array antenna configured to execute wireless communication with a small-cell base station in the higher frequency band (including the millimeter-wave frequency band). In general, as the used frequency is higher, the linearity of the electromagnetic wave becomes higher and the reach range of the electromagnetic wave becomes shorter. For this reason, the antenna for the higher frequency band is implemented as an array antenna 6 capable of executing beam forming to cover a wider range.

The array antenna 6 (hereinafter called a millimeter-wave array antenna) is configured to execute transmission and reception of the electromagnetic wave in the higher frequency band (including the millimeter-wave frequency band).

The millimeter-wave array antenna 6 comprises a plurality of radiation elements (hereinafter called millimeter-wave antenna elements) 7. Each of the millimeter-wave antenna elements 7 may be a flat conductor.

In the present embodiment, each of the millimeter-wave antenna elements 7 of the millimeter-wave array antenna 6 is implemented as a patch antenna. In other words, the plurality of millimeter-wave antenna elements 7 of the millimeter-wave array antenna 6 are arranged on a back surface (second surface) 2B of the second substrate 2 and are opposed to the ground plane 5 of the LTE antenna via the substrate 2. Each of the millimeter-wave antenna elements 7 may be formed in a conductor pattern on the back surface (second surface) 2B of the substrate 2. The ground plane 5 and the plurality of millimeter-wave antenna elements 7 function as a plurality of patch antennas. In other words, the ground plane 5 serves as a ground of the LTE antenna and a ground of the millimeter-wave array antenna 6 (a plurality of patch antennas).

In the present embodiment, the ground plane 5 of the LTE antenna and the plurality of millimeter-wave antenna elements 7 are arranged to be superposed on each other on the both surfaces of the substrate 2 but, as explained above, the millimeter-wave array antenna 6 is implemented as the plurality of patch antennas composed of the ground plane 5 and the plurality of millimeter-wave antenna elements 7 (planar radiation elements). The performance of the millimeter-wave array antenna 6 can be thereby prevented from being deteriorated by the ground plane 7.

In the present embodiment, the millimeter-wave antenna elements 7 are opposed to a region of part of the ground plane 5 via the substrate 2.

The region may be set at a position remote from the periphery of the ground plane 5 (i.e., a central region of the ground plane 5), in the ground plane 5. In this constitution, an influence of the current of the LTE antenna flowing on the ground plane 5 to the millimeter-wave array antenna 6 can be reduced. This is because, since most of the current on the LTE antenna flows along each edge of the periphery of the ground plane 5 as explained above, the amount of the current flowing in the central region remote from the periphery of the ground plane 5 is small.

The millimeter-wave radio frequency (RF) module 8 configured to feed the radio frequency (RF) signals of the millimeter-wave frequency band to the plurality of millimeter-wave antenna elements 7 may also be arranged on the substrate 2.

The position on the substrate 2 at which the millimeter-wave radio frequency (RF) module 8 should be arranged is not particularly limited. In the antenna structure shown in FIG. 1 to FIG. 3, the millimeter-wave radio frequency (RF) module 8 is arranged on the top surface (first surface) 2A of the substrate 2.

To set a distance between the millimeter-wave radio frequency (RF) module 8 and each millimeter-wave antenna element 7 to be sufficiently short, the millimeter-wave radio frequency (RF) module 8 may be arranged at a position opposed to the plurality of millimeter-wave antenna elements 7 via the ground plane 5 and the substrate 2. In this case, terminals of the millimeter-wave radio frequency (RF) module 8 may be connected to the millimeter-wave antenna elements 7 via, for example, a via pattern penetrating the ground plane 5 and the substrate 2.

The integrated antenna module 1 comprising the LTE antenna and the array antenna 6 can be implemented in the same size as the size of the LTE antenna (i.e., the LTE antenna element 3 and the ground plane 5), in the above-explained antenna structure.

Thus, the antennas of two different types, i.e., the millimeter-wave array antenna 6 and the LTE antenna, can be provided inside the wireless device without increasing the antenna incorporation space which should be secured inside the wireless device.

Figure 4:
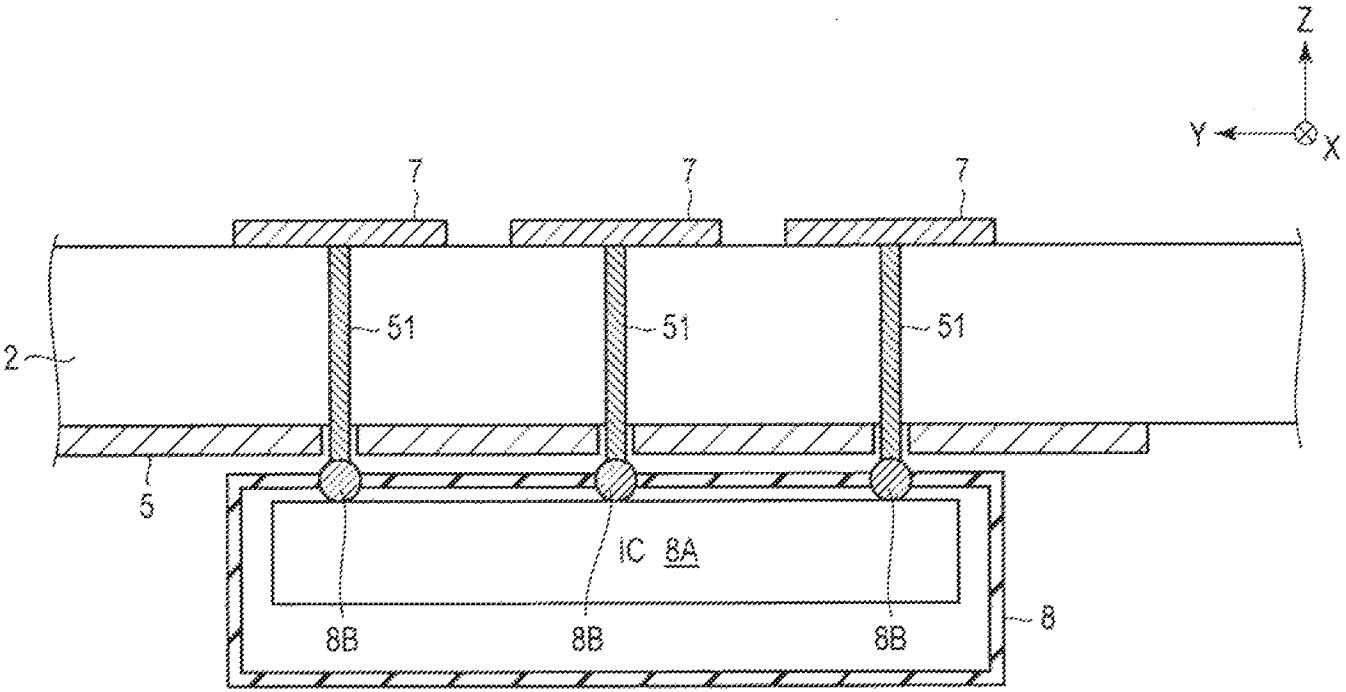
FIG. 4 is an exemplary cross-sectional view showing the antenna module of the embodiment.

FIG. 4 is a cross-sectional view seen along IV-IV line in FIG. 3.

As explained above, millimeter-wave radio frequency (RF) module 8 may be arranged on the surface (top surface) 2A opposed to the surface (back surface) 2B on which the plurality of millimeter-wave antenna elements 7 are arranged.

Each of the millimeter-wave antenna elements 7 is electrically connected to the millimeter-wave radio frequency (RF) module 8 through via 51 in the substrate 2. The millimeter-wave radio frequency (RF) module 8 comprises an IC 8A and a plurality of terminals 8B connected to the vias 51. On the ground plane 5, a periphery of each of the vias 51 may be removed. In other words, each of the vias 51 is electrically insulated from the ground plane 5.

Figure 5:
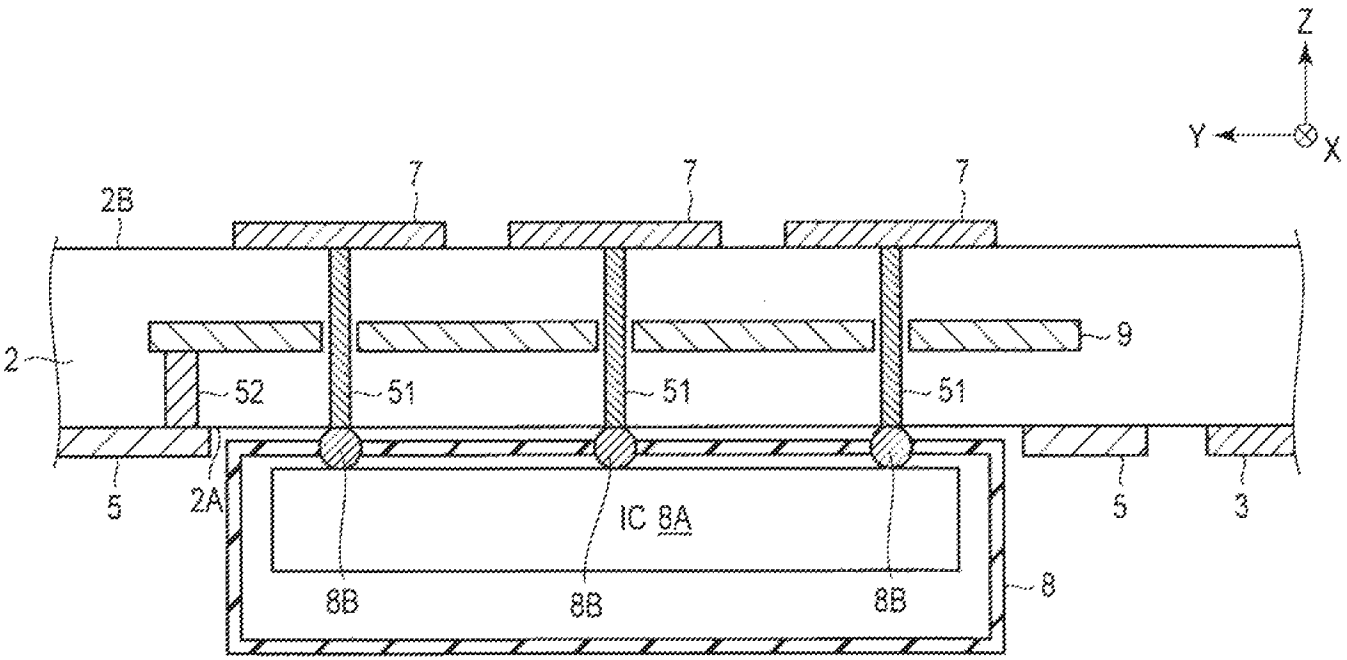
FIG. 5 is another exemplary side view showing the antenna module of the embodiment.

In another embodiment, as shown in FIG. 5, in the substrate 2, a ground plane 9 may be provided in a layer between the plurality of millimeter-wave antenna elements 7 and the millimeter-wave radio frequency (RF) module 8.

Each of the millimeter-wave antenna elements 7 is electrically connected to the millimeter-wave radio frequency (RF) module 8 through the via 51 in the substrate 2. The millimeter-wave radio frequency (RF) module 8 comprises an IC 8A and a plurality of terminals 8B connected to the vias 51. On the ground plane 9, a periphery of each of the vias 51 may be removed. In other words, each of the vias 51 is electrically insulated from the ground plane 9. The ground plane 5 and the ground 9 are electrically connected to each other through a via 52. The ground plane 5 may comprise an opening through which a part of the top surface 2A of the substrate 2 is exposed. In this case, the millimeter-wave radio frequency (RF) module 8 may be arranged on the exposed portion of the top surface 2A of the substrate 2.

FIG. 6 to FIG. 10 are side views showing another structure of the integrated antenna module 1.

Figure 6:
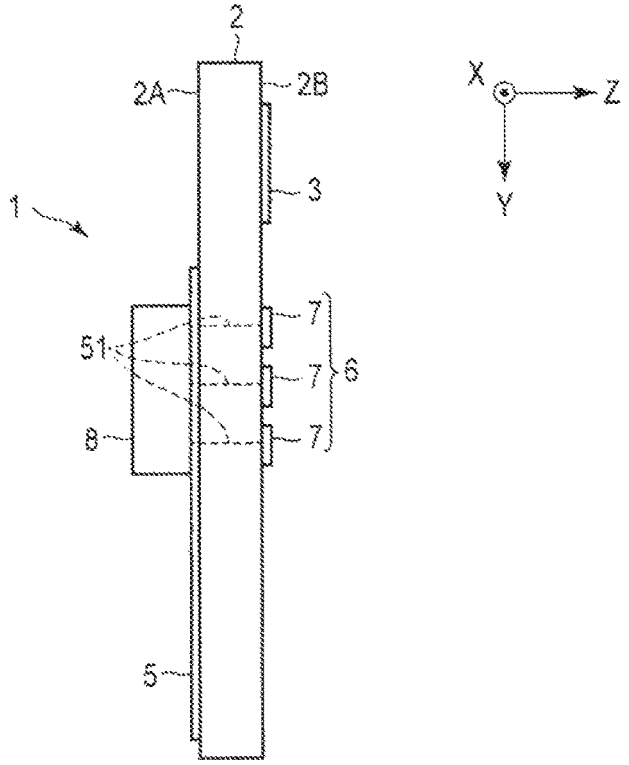
FIG. 6 is an exemplary side view showing another structure of the antenna module of the embodiment.

In the antenna structure shown in FIG. 6, the LTE antenna element 3, and the plurality of millimeter-wave antenna elements 7 of the millimeter-wave array antenna 6 are arranged on the second surface 2B of the second substrate 2 and the ground plane 5 of the LTE antenna is arranged on the first surface 2A of the substrate 2. The feed point 4 shown in FIG. 1 may be arranged on the first surface 2A or the second surface 2B of the substrate 2.

Figure 7:
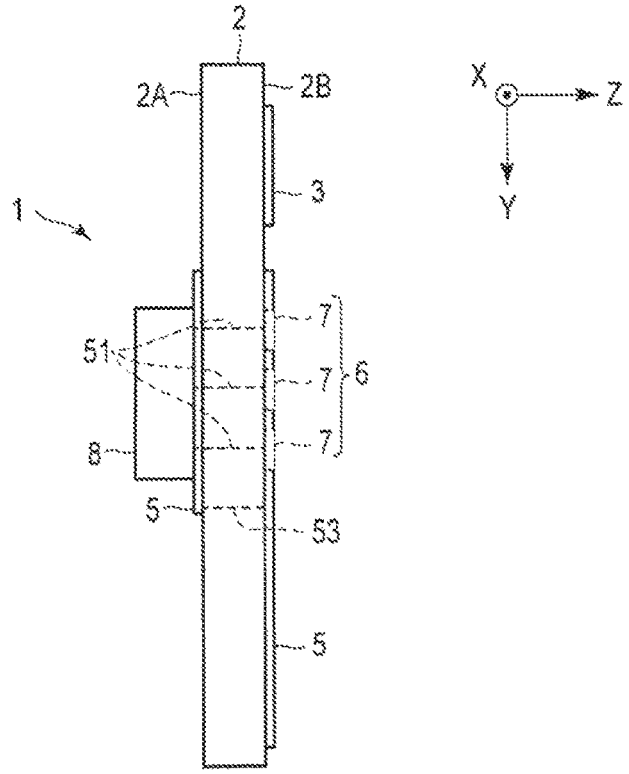
FIG. 7 is an exemplary side view showing yet another structure of the antenna module of the embodiment.

In the antenna structure shown in FIG. 7, the LTE antenna element 3, the plurality of millimeter-wave antenna elements 7 and the ground plane 5 are arranged on the second surface 2B of the substrate 2. The ground plane 5 on the second surface 2B includes an opening, and the plurality of millimeter-wave antenna elements 7 are arranged on a region of the second surface 2B which is exposed through the opening. On the first surface 2A of the substrate 2, the ground plane 5 is left on the only region opposed to the plurality of millimeter-wave antenna elements 7. The ground plane 5 on the first surface 2A may be electrically connected to the ground plane 5 on the second surface 2B through a via 53.

Figure 8:
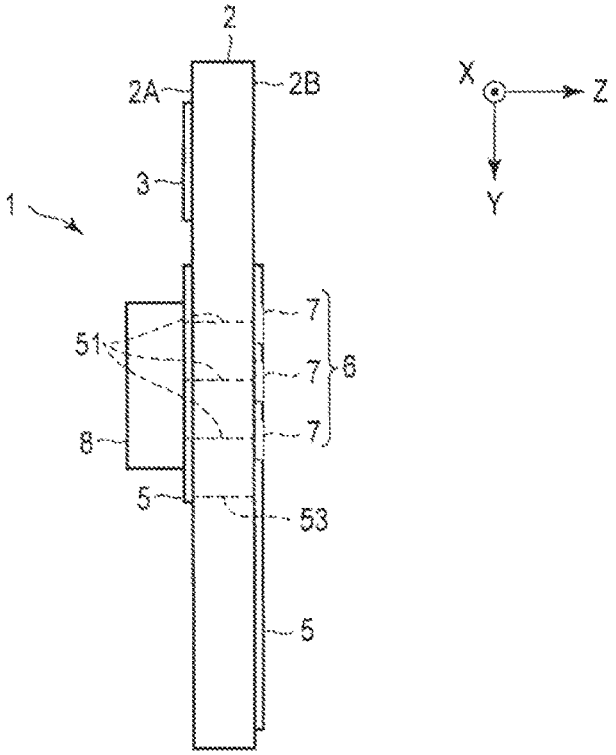
FIG. 8 is an exemplary side view showing yet another structure of the antenna module of the embodiment.

In the antenna structure shown in FIG. 8, the LTE antenna element 3 is arranged on the first surface 2A of the substrate 2, and the plurality of millimeter-wave antenna elements 7 and the ground plane 5 are arranged on the second surface 2B of the substrate 2. The ground plane 5 includes an opening, and the plurality of millimeter-wave antenna elements 7 are arranged on a region of the second surface 2B which is exposed through the opening. On the first surface 2A of the substrate 2, the ground plane 5 is left on the only region opposed to the plurality of millimeter-wave antenna elements 7. The ground plane 5 on the first surface 2A may be electrically connected to the ground plane 5 on the second surface 2B through the via 53.

Figure 9:
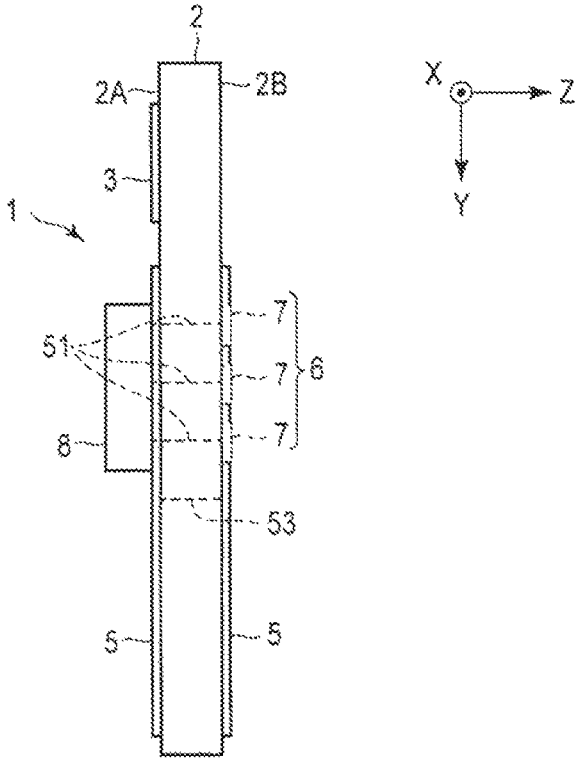
FIG. 9 is an exemplary side view showing yet another structure of the antenna module of the embodiment.

In the antenna structure shown in FIG. 9, the LTE antenna element 3 is arranged on the first surface 2A of the substrate 2, and the plurality of millimeter-wave antenna elements 7 are arranged on the second surface 2B of the substrate 2. Furthermore, the ground plane 5 is arranged on each of the first surface 2A and the second surface 2B. The ground plane 5 on the second surface 2B includes an opening, and the plurality of millimeter-wave antenna elements 7 are arranged on a region of the second surface 2B which is exposed through the opening. The ground plane 5 on the first surface 2A may be electrically connected to the ground plane 5 on the second surface 2B through the via 53.

Figure 10:
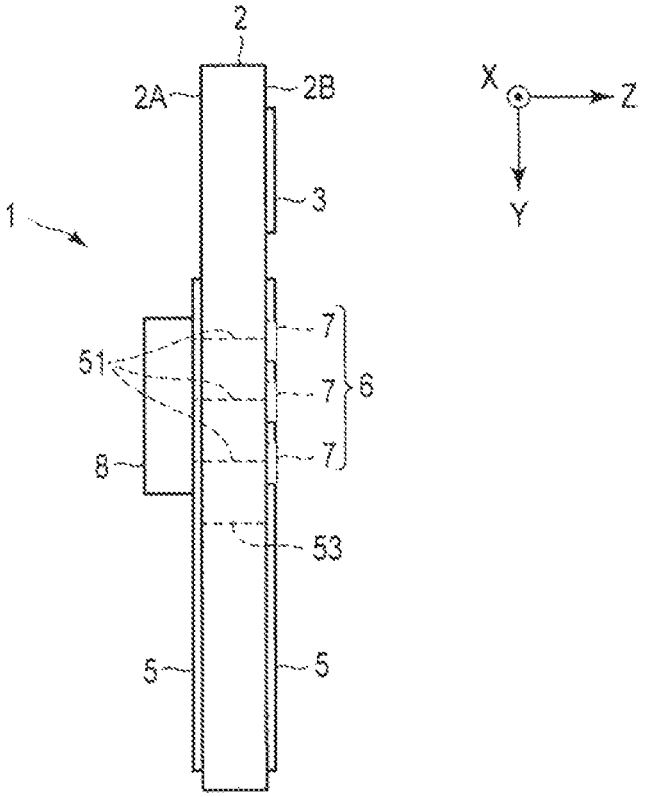
FIG. 10 is an exemplary side view showing yet another structure of the antenna module of the embodiment.

In the antenna structure shown in FIG. 10, the LTE antenna element 3 and the plurality of millimeter-wave antenna elements 7 are arranged on the second surface 2B of the substrate 2. Furthermore, the ground plane 5 is arranged on each of the first surface 2A and the second surface 2B.

The ground plane 5 on the second surface 2B includes an opening, and the plurality of millimeter-wave antenna elements 7 are arranged on a region of the second surface 2B which is exposed through the opening. The ground plane 5 on the first surface 2A may be electrically connected to the ground plane 5 on the second surface 2B through the via 53.

Figure 11:
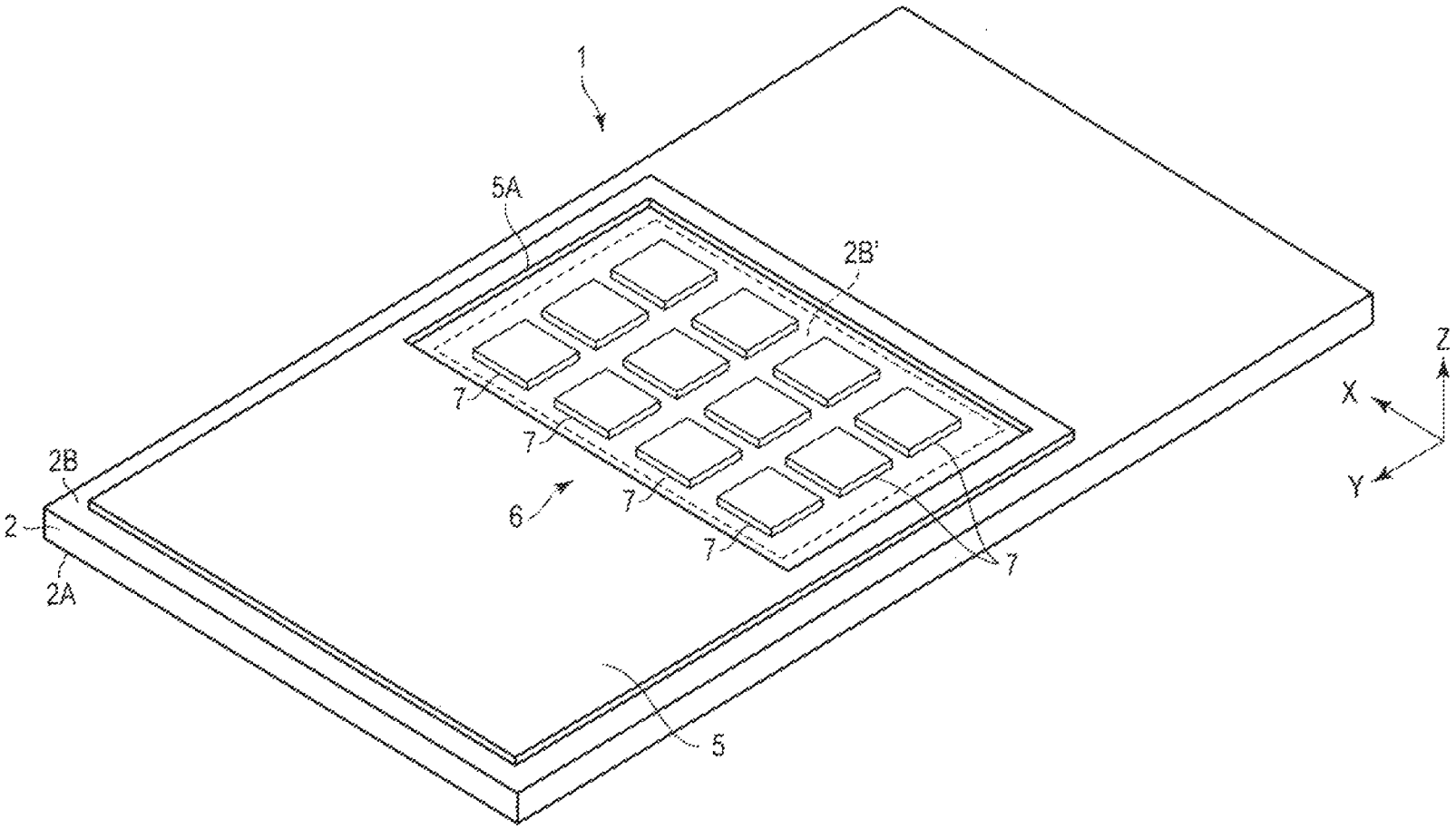
FIG. 11 is an exemplary perspective view showing arrangement of a ground plane and millimeter-wave antenna elements on the back surface side of the antenna module shown in FIG. 7 to FIG. 10.

FIG. 11 shows arrangement of the ground plane 5 and the plurality of millimeter-wave antenna elements 7 on the back surface side of the antenna module 1 shown in FIG. 7 to FIG. 10.

As shown in FIG. 11, the ground plane 5 on the second surface 2B of the substrate 2 includes an opening 5A in a rectangular shape. A second region 2B' on the second surface 2B is exposed through the opening 5A of the ground plane 5. The plurality of millimeter-wave antenna elements 7 of the millimeter-wave array antenna 6 are arranged on the second surface 2B'. A certain distance is secured between an outer periphery of the plurality of millimeter-wave antenna elements 7 and an outer periphery of the opening 5A of the ground plane 5. Deterioration of the performance of the millimeter-wave array antenna 6 caused by the ground plane 5 on the second surface 2B can be thereby suppressed.

Figure 12:
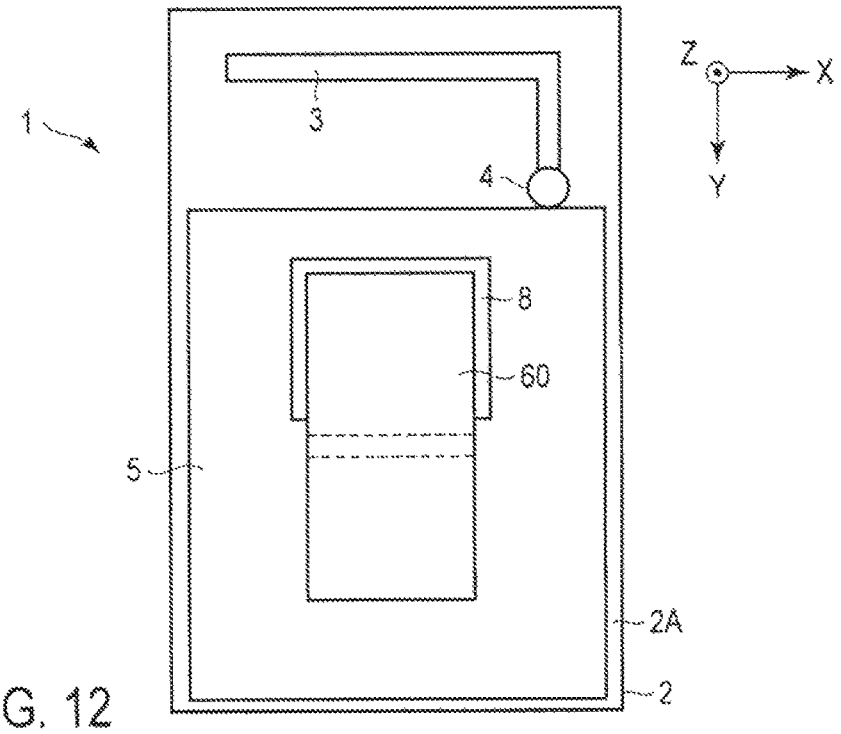
FIG. 12 is an exemplary illustration showing a heat radiation structure applied to the antenna module of the embodiment.
Figure 13:
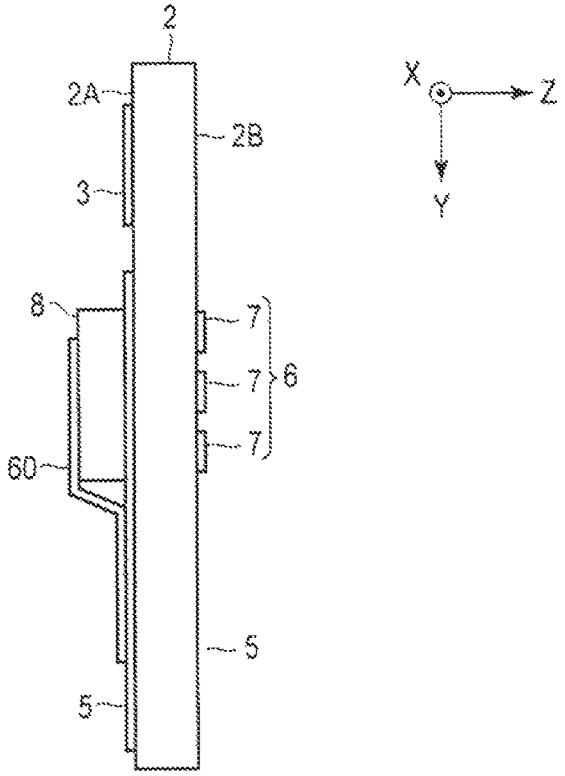
FIG. 13 is a side view showing the heat radiation structure shown in FIG. 12.

FIG. 12 and FIG. 13 show a heat radiation structure applied to the antenna module 1. The heat radiation structure is used to eliminate the heat generated from the millimeter-wave radio frequency (RF) module 8 via the ground plane 5.

At least a part of the ground plane 5 is arranged on the same surface (for example, first surface 2A) as the surface of the substrate 2 on which the millimeter-wave radio frequency (RF) module 8 is mounted.

A thermally conductive sheet 60 is applied onto the millimeter-wave radio frequency (RF) module 8 and the ground plane 5. The thermally conductive sheet 60 is a thermally conductive member which transfers the heat of the millimeter-wave radio frequency (RF) module 8 to the ground plane 5.

In the heat radiation structure, the heat generated inside the millimeter-wave radio frequency (RF) module 8 by operating the millimeter-wave radio frequency (RF) module 8 is transferred to the ground plane 5 via the thermally conductive sheet 60 and eliminated via the ground plane 5.

Figure 14:
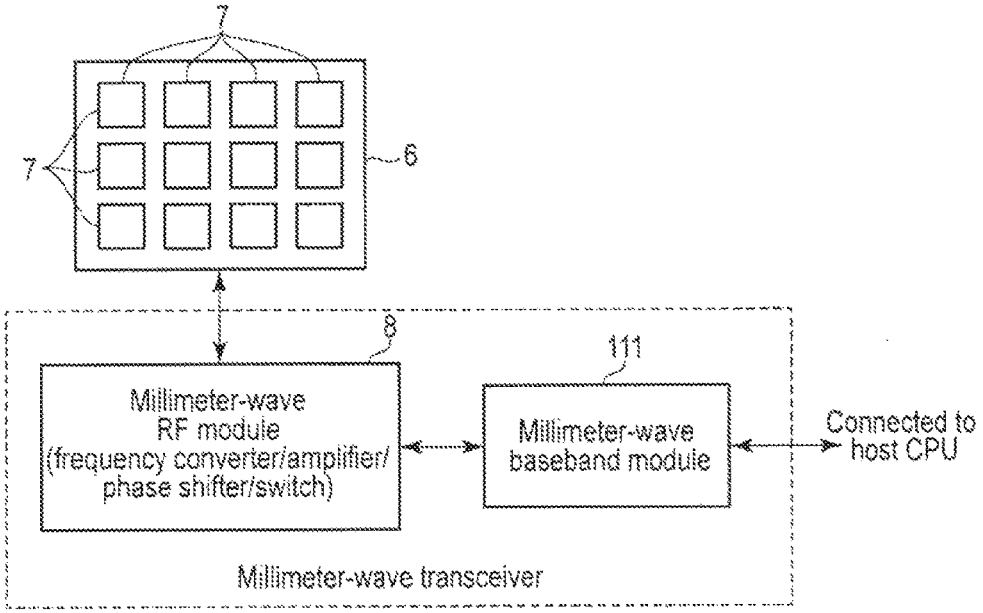
FIG. 14 is an illustration showing an array antenna and an RF module provided inside the antenna module of the embodiment.

FIG. 14 shows an example of the configuration of the millimeter-wave radio frequency (RF) module 8 and the millimeter-wave array antenna 6.

The millimeter-wave array antenna 6 comprises a plurality of millimeter-wave antenna elements 7 arranged on the substrate 2. The millimeter-wave antenna elements 7 may be two-dimensionally spaced apart from each other with regular intervals. Each of the millimeter-wave antenna elements 7 may be formed in a conductor pattern on the substrate 2.

Each of the millimeter-wave antenna elements 7 is connected to the millimeter-wave radio frequency (RF) module 8. The millimeter-wave radio frequency (RF) module 8 is connected to a millimeter-wave baseband module 111. The millimeter-wave baseband module 111 is connected to a host CPU (processor) in the above-explained wireless device.

The millimeter-wave radio frequency (RF) module 8 is composed of a frequency converter, an amplifier, a phase shifter, a switch, etc. The frequency converter executes conversion between a millimeter-wave radio frequency (RF) signal and a baseband signal.

The switch changes combination of the millimeter-wave antenna elements 7 which should be used for radiation of the electromagnetic wave and thereby varies an angle of radiation of the radio wave emitted from the millimeter-wave array antenna 6 (beam-forming function).

The millimeter-wave baseband module 111 is configured to execute conversion between the baseband signal and the data signal. The millimeter-wave radio frequency (RF) module 8 and the millimeter-wave baseband module 111 function as millimeter-wave transceivers configured to execute wireless communication in the millimeter-wave frequency band.

Figure 15:
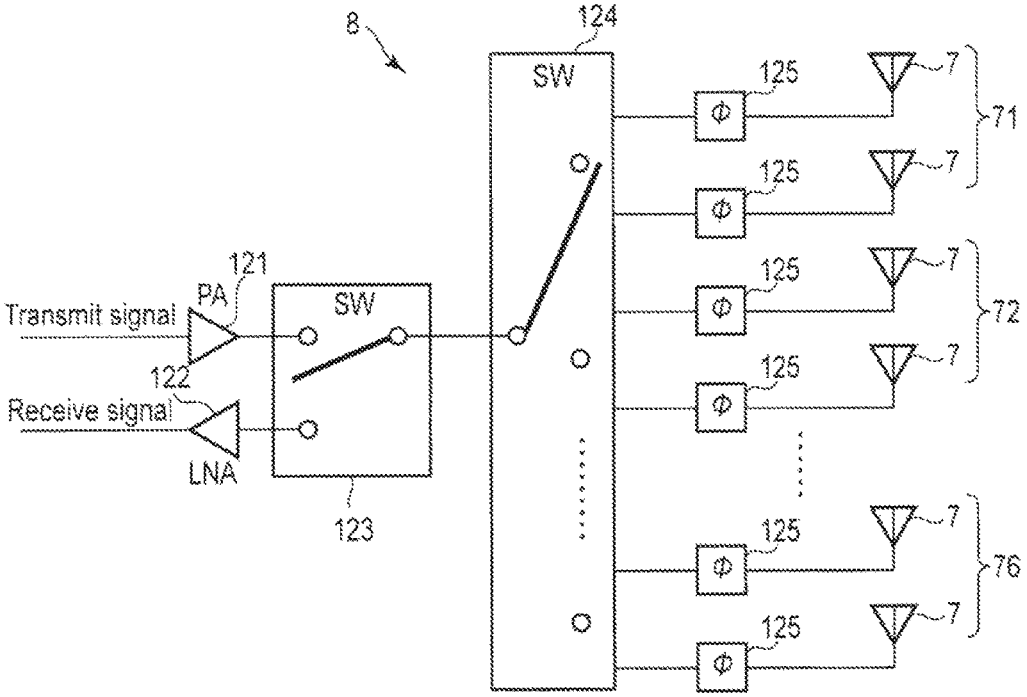
FIG. 15 is an exemplary circuit diagram showing a structure of the RF module shown in FIG. 14.

FIG. 15 shows a circuit example of the millimeter-wave radio frequency (RF) module 8.

The millimeter-wave radio frequency (RF) module 8 comprises a power amplifier (PA) 121, a low noise amplifier (LNA) 122, a switch (SW) 123 configured to change transmission and reception, a switch (SW) 124 configured to change combination of the millimeter-wave antenna elements 7 which should be used, a plurality of phase shifters 125, etc. For example, the phase shifters 125 produce signals having phases different from each other. The switch (SW) 124 changes combination of the millimeter-wave antenna elements 7 which should be used for radiation of the electromagnetic wave. A plurality of millimeter-wave antenna elements 7 may be included in each combination and, for example, each combination may include two millimeter-wave antenna elements 7 or at least three millimeter-wave antenna elements 7.

In FIG. 15, each combination includes two millimeter-wave antenna elements 7. In this case, for example, six combinations denoted by numbers 71 to 76 may be selectively used. The combination of the millimeter-wave antenna elements 7 which should be used for radiation of the electromagnetic wave is changed by the switch (SW) 124, and the angle of radiation of the radio wave emitted from the millimeter-wave array antenna 6 can be thereby changed.

FIG. 15 shows a circuit example, and various circuits capable of executing beam-forming can be applied to the millimeter-wave radio frequency (RF) module 8.

Figure 16:
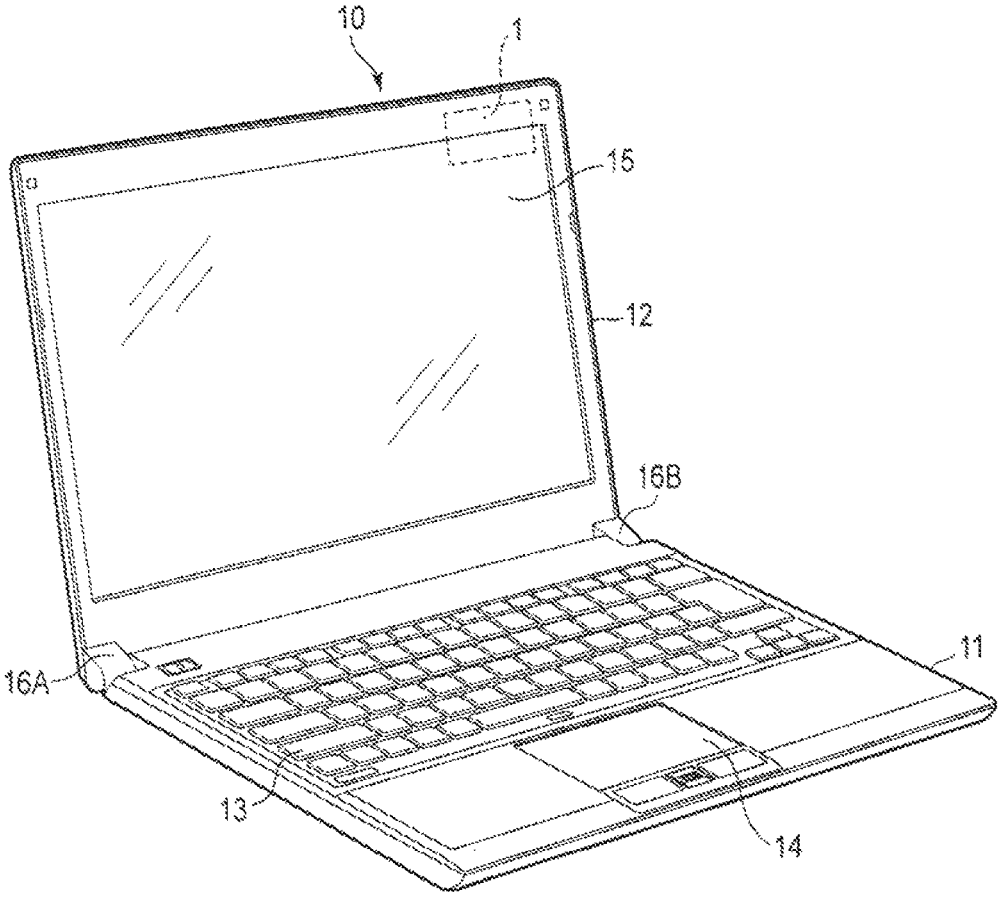
FIG. 16 is an exemplary perspective view showing an electronic device incorporating the antenna module of the embodiment mounted thereon.

FIG. 16 is a perspective view showing an electronic device incorporating the integrated antenna module 1.

The electronic device is the wireless device, and may be implemented as notebook personal computers, tablet computers, smartphones, PDA, or the like or may be implemented as various Internet of Things (IoT) terminals such as vending machines, sensor devices, etc.

It is hereinafter assumed that the electronic device is implemented as a notebook-type personal computer 10.

The computer 10 comprises a computer main body 11 and a display unit 12. A display device such as a liquid crystal display (LCD) 15 is incorporated in the display unit 12.

The display unit 12 is attached to the computer main body 11 so as to be rotatable between an opened position at which the top surface of the computer main body 11 is exposed and a closed position at which the top surface of the computer main body 11 is covered with the display unit 12. A lower end portion of the display unit 12 is coupled to a rear end portion of the computer main body 11 via rotatable hinges 16A and 16B.

The computer main body 11 comprises a housing shaped in a thin box, and a keyboard 13 and a touch pad (pointing device) 14 are arranged on the top surface of the housing.

The integrated antenna module 1 may be arranged inside the housing of the display unit 12. The integrated antenna module 1 may be arranged on, for example, the back surface side of the LCD 15, inside the housing of the display unit 12. The integrated antenna module 1 may be arranged near an upper end portion of the display unit 12.

If the electronic device is a tablet computer or a smartphone, the integrated antenna module 1 is arranged inside the housing of the tablet computer or the housing of the smartphone.

Figure 17:
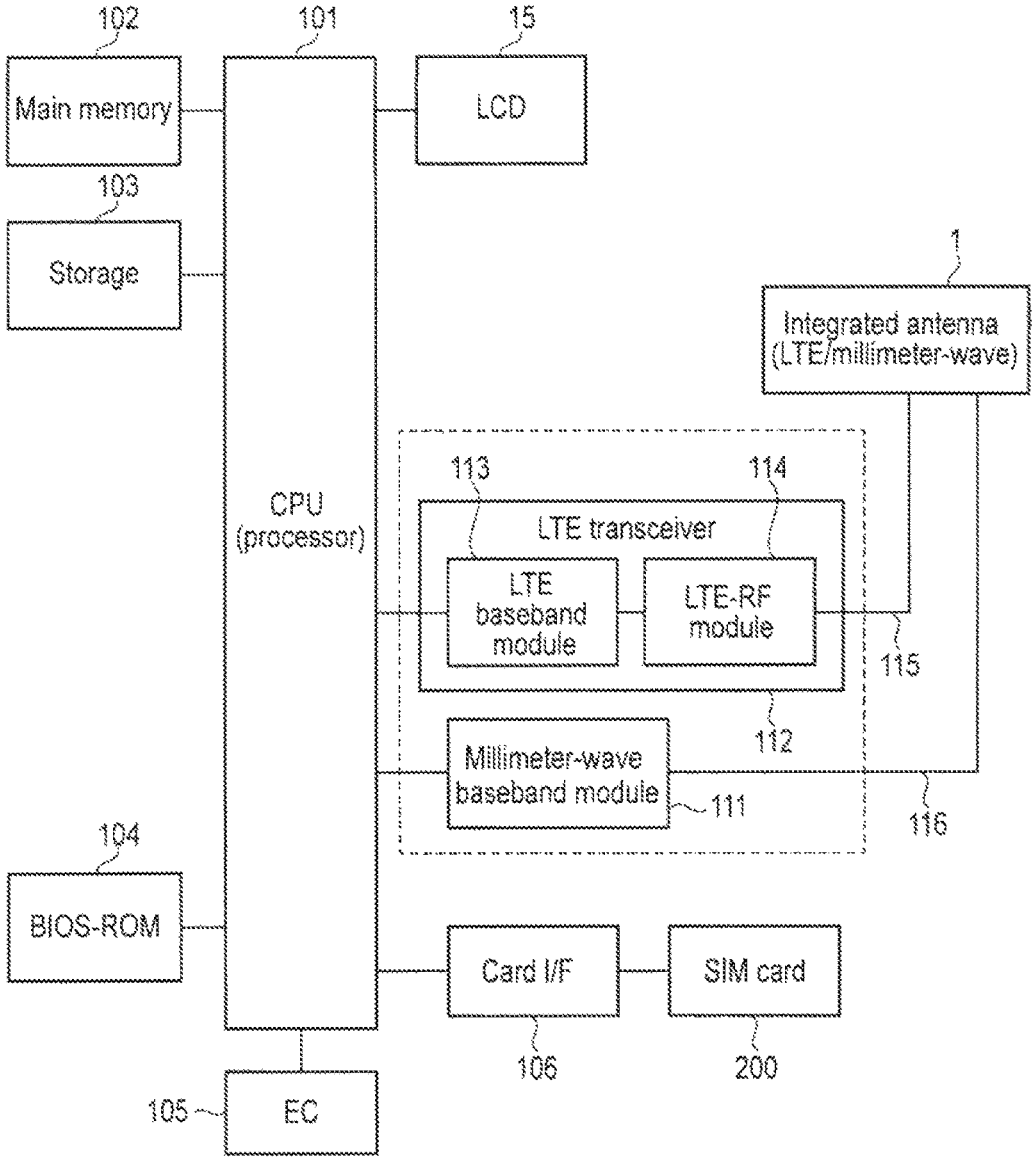
FIG. 17 is an exemplary block diagram showing a system configuration of the electronic device shown in FIG. 16.

FIG. 17 shows a system configuration of the computer 10.

The computer 10 comprises a CPU 101, a main memory 102, a storage device 103, a BIOS-ROM 104, an embedded controller (EC) 105, a card interface 106 and an LTE transceiver 112, besides the LCD 15, the integrated antenna module 1, and the millimeter-wave baseband module 111.

The CPU 101 is a processor configured to process the data, and controls the operations of each of the components in the computer 10. The CPU 101 includes a circuit (processing circuit). The CPU 101 loads software and user data from the storage device 103 such as an HDD or SDD on the main memory 102. Then, the CPU 101 executes software 300. The software includes an operating system (OS), various driver programs and various application programs. The driver programs include a communication control program. The communication control program controls transmission and reception of control signals (control-plane) using the LTE frequency band (i.e., the cellular frequency band) and transmission and reception of data signals (user-plane) using the millimeter-wave frequency band.

In addition, the CPU 101 also executes a Basic Input/Output System (BIOS) stored in the BIOS-ROM 104 which is a nonvolatile memory. The BIOS is a system program for hardware control.

The EC 105 functions as a system controller configured to execute power management of the computer 10. The EC 105 has a function of powering on and off the computer 10 in response to user operations of the power switch. At power-on of the computer 10, the EC 105 controls a power-on sequence (control of reset timing and control of reset cancellation timing) of each component in the computer 10. The EC 105 is implemented as a processing circuit such as a single-chip microcomputer. The EC 105 may incorporate a keyboard controller configured to control input devices such as the keyboard (KB) 13 and the touch pad 14.

The card interface 106 interfaces with a Subscriber Identity Module (SIM) card 200. The SIM card 200 is a storage device which stores at least subscriber information. The subscriber information is intrinsic identification information preliminarily allocated to identify the wireless device (computer 10).

Each of the LTE transceiver 112 and the millimeter-wave baseband module 111 is electrically connected to the CPU 101 via a bus. The LTE transceiver 112 and the millimeter-wave baseband module 111 function as a transceiver configured to execute wireless communication using the lower frequency band and the higher frequency band.

The LTE transceiver 112 comprises an LTE baseband module 113 and an LTE radio frequency (RE) module 114. The LTE radio frequency (RE) module 114 is connected to the integrated antenna module 1 via a feeder 115 such as a coaxial cable. More specifically, the coaxial cable is connected to the feed point (coaxial connector) 4 explained with reference to FIG. 1.

The millimeter-wave baseband module 111 is connected to the integrated antenna module 1 via a signal line 116. More specifically, the signal line 116 is connected to the millimeter-wave radio frequency (RF) module 8 in the integrated antenna module 1.

The LTE transceiver 112 and the millimeter-wave baseband module 111 may be implemented as devices different from each other or may be integrated inside the same device.

Figure 18:
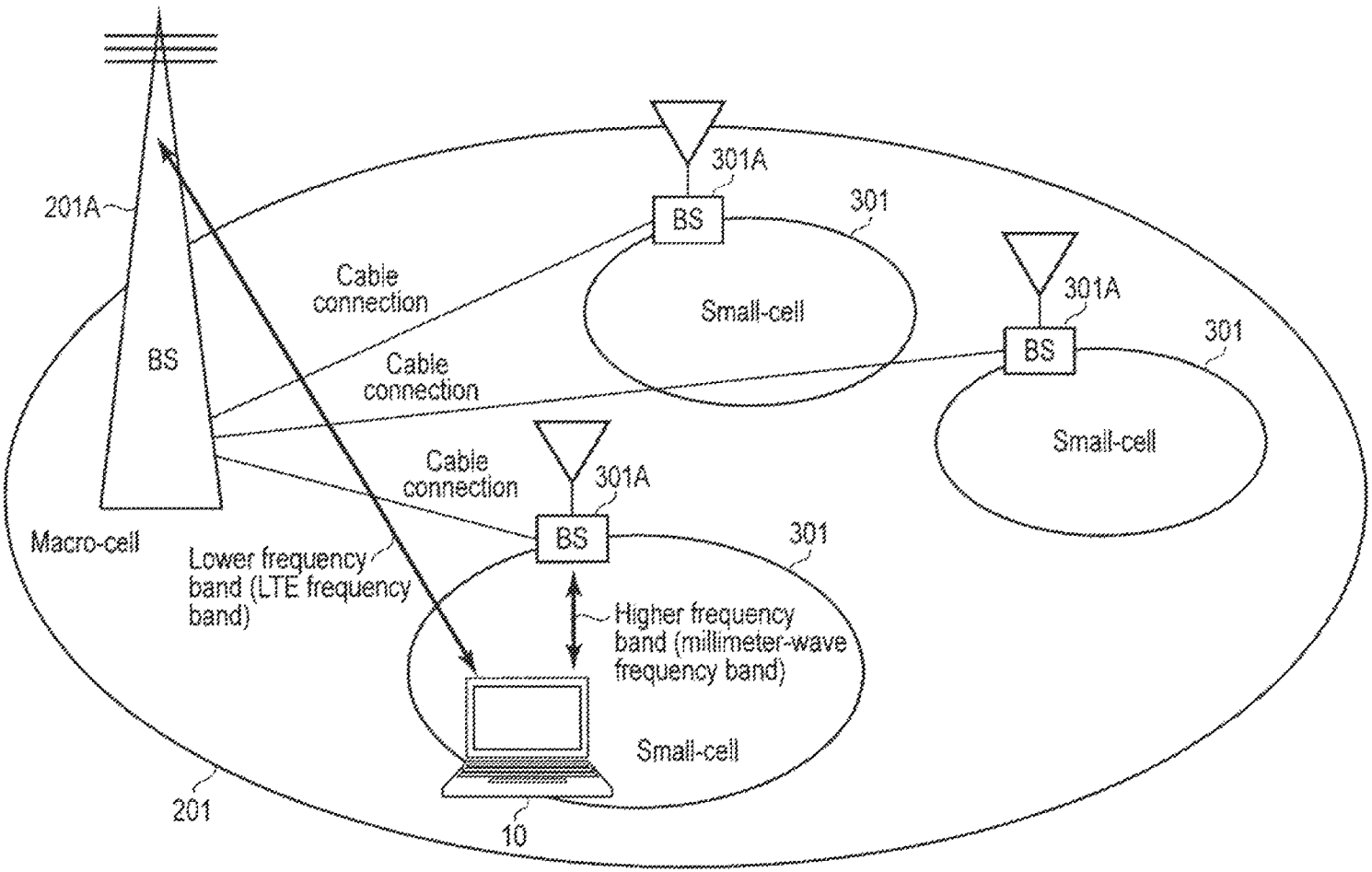
FIG. 18 is an exemplary illustration showing a relationship between the electronic device shown in FIG. 16 and a wireless communication network.

FIG. 18 shows a relationship between the computer 10 and the wireless communication network.

The wireless communication network is a mobile network such as a fifth-generation cellular system. The wireless communication network includes a plurality of macro-cells 201. Each macro-cell 201 includes a macro-cell base station as a base station having a large transmission power.

The lower frequency band such as the LTE frequency band is used for wireless communication between a macro-cell base station 201A and the computer 10. In other words, the computer 10 executes transmission and reception of the control signals (control-plane) to and from the macro-cell base station 201A by using the LTE antenna in the integrated antenna module 1.

A plurality of small-cells 301 are additionally arranged in each macro-cell 201. Each small-cell 301 includes a small-cell base station 301A as a base station having a small transmission power. The macro-cell base station 201A and each small-cell base station 301A are interconnected to each other via a cable transmission path.

The lower frequency band such as the millimeter-wave frequency band is used for wireless communication between the small-cell base stations 301A and the computer 10. In other words, the computer 10 executes transmission and reception of the data signals (user-plane) to and from each small-cell base station 301A by using the millimeter-wave array antenna 6 in the integrated antenna module 1.

In the present embodiment, as explained above, the antenna for lower frequency band (LTE antenna) comprising the LTE antenna element 3 and the ground plane 5, and the millimeter-wave array antenna 6 comprising the plurality of millimeter-wave antenna elements 7 are arranged on the single substrate 2. The plurality of millimeter-wave antenna elements 7 of the millimeter-wave array antenna 6 are arranged on the surface opposed to the surface of the substrate 2 on which the ground plane 5 is arranged, and are opposed to the ground plane 5 via the substrate 2. Thus, the ground plane 5 and the plurality of millimeter-wave antenna elements 7 function as a plurality of patch antennas, and the ground plane 5 serves as a ground of the LTE antenna and a ground of the millimeter-wave array antenna 6 (a plurality of patch antennas).

In this antenna structure, the integrated antenna module 1 comprising the millimeter-wave array antenna 6 corresponding to the millimeter-wave frequency band connected to the new radio system, and the LTE antenna corresponding to the LTE frequency band connected to the LTE system, can be implemented in the same size as the size of the LTE antenna (i.e., the LTE antenna element 3 and the ground plane 5). The millimeter-wave array antenna 6 and the LTE antenna can be therefore provided inside the wireless device without increasing the antenna incorporation space which should be secured inside the wireless device.

The various modules of the systems described herein can be implemented as software applications, hardware and/or software modules, or components on one or more computers, such as servers. While the various modules are illustrated separately, they may share some or all of the same underlying logic or code.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An antenna module, comprising: a substrate; a first antenna including a first radiation element arranged on the substrate, a ground plane connected to the first radiation element, and a feed point arranged between the first radiation element and the ground plane, the first antenna transmitting and receiving electromagnetic waves of a first frequency band; a second antenna including a plurality of second radiation elements arranged on the substrate, the second antenna transmitting and receiving electromagnetic waves of a second frequency band higher than the first frequency band; and a radio frequency (RF) module connected to the second antenna, the radio frequency (RF) module feeding radio frequency (RF) signals of the second frequency band to the second antenna, the substrate including a first surface and a second surface, the ground plane being arranged on at least the first surface of the substrate, the plurality of second radiation elements being arranged on the second surface of the substrate and opposed to the ground plane, the first antenna being a monopole antenna placed on the first surface, and the second antenna being a millimeter wave antenna, wherein the plurality of second radiation elements and the radio frequency (RF) module are connected to each other by a plurality of vias which penetrate the substrate and the ground plane, and wherein the vias are electrically insulated from the ground plane.

2. The antenna module of claim 1, wherein the first radiation element and the ground plane function as an antenna for a cellular communication system, the ground plane and the plurality of second radiation elements function as a plurality of patch antennas, and the second frequency band includes a millimeter-wave frequency band.

3. The antenna module of claim 1, wherein the ground plane includes a region which is larger than a region in which the first radiation element is arranged, and the plurality of second radiation elements are arranged on a first area of the second surface of the substrate, the first area of the second surface being opposed to a central region of the ground plane.

4. The antenna module of claim 1, wherein at least a part of the ground plane and the radio frequency (RF) module are arranged on the first surface of the substrate, and the antenna module further comprises a thermally conductive member that connects an upper surface of the radio frequency (RF) module to the ground plane and transfers heat generated from the radio frequency (RF) module to the ground plane.

5. The antenna module of claim 4, wherein the thermally conductive member includes a thermally conductive sheet applied onto the upper surface of the radio frequency (RF) module and the ground plane.

6. An electronic device, comprising: a processor that processes data; a transceiver connected to the processor, the transceiver executing wireless communication using a first frequency band and a second frequency band higher than the first frequency band; and an antenna module, wherein the antenna module comprises: a substrate including a first surface and a second surface; a first antenna including a first radiation element arranged on the substrate and a ground plane connected to the first radiation element, and a feed point arranged between the first radiation element and the ground plane, the first antenna transmitting and receiving electromagnetic waves of the first frequency band; a second antenna including a plurality of second radiation elements arranged on the substrate, the second antenna transmitting and receiving electromagnetic waves of the second frequency band; and a radio frequency (RF) module that feeds radio frequency (RF) signals of the second frequency band to the second antenna, the ground plane being arranged on at least the first surface of the substrate, the plurality of second radiation elements being arranged on the second surface of the substrate and opposed to the ground plane, the first antenna being a monopole antenna placed on the first surface, and the second antenna being a millimeter wave antenna, wherein the plurality of second radiation elements and the radio frequency (RF) module are connected to each other by a plurality of vias which penetrate the substrate and the ground plane, and wherein the vias are electrically insulated from the ground plane.

7. The electronic device of claim 6, wherein the first radiation element and the ground plane function as an antenna for a cellular communication system, the ground plane and the plurality of second radiation elements function as a plurality of patch antennas, and the second frequency band includes a millimeter-wave frequency band.

8. The electronic device of claim 6, wherein the ground plane includes a region which is larger than a region in which the first radiation element is arranged, and the plurality of second radiation elements are arranged on a first area of the second surface of the substrate, the first area of the second surface being opposed to a central region of the ground plane.

9. The electronic device of claim 6, wherein at least a part of the ground plane and the radio frequency (RF) module are arranged on the first surface of the substrate, and the electronic device further comprises a thermally conductive member that connects an upper surface of the radio frequency (RF) module to the ground plane and transfers heat generated from the radio frequency (RF) module to the ground plane.

10. The electronic device of claim 9, wherein the thermally conductive member includes a thermally conductive sheet applied onto the upper surface of the radio frequency (RF) module and the ground plane.

* * * * *